US007875411B2

(12) United States Patent
Aziz et al.

(10) Patent No.: US 7,875,411 B2
(45) Date of Patent: Jan. 25, 2011

(54) PHOTORECEPTOR CONTAINING SUBSTITUTED BIPHENYL DIAMINE AND METHOD OF FORMING SAME

(75) Inventors: Hany Aziz, Oakville (CA); Gregory McGuire, Mississauga (CA); Jennifer A. Coggan, Cambridge (CA); Johann Junginger, Toronto (CA); Kathy L. De Jong, Mississauga (CA); Ah-Mee Hor, Mississauga (CA); Nan-Xing Hu, Oakville (CA)

(73) Assignee: Xerox Corporation, Norwalk, CT (US)

( * ) Notice: Subject to any disclaimer, the term of this patent is extended or adjusted under 35 U.S.C. 154(b) by 895 days.

(21) Appl. No.: 11/756,077

(22) Filed: May 31, 2007

(65) Prior Publication Data

US 2008/0102388 A1 May 1, 2008

Related U.S. Application Data

(60) Provisional application No. 60/863,426, filed on Oct. 30, 2006.

(51) Int. Cl.
*G03G 5/00* (2006.01)

(52) U.S. Cl. ..... 430/66; 430/58.8

(58) Field of Classification Search ..... 430/58.8, 430/66

See application file for complete search history.

(56) References Cited

U.S. PATENT DOCUMENTS 4,050,935 A 9/1977 Limburg et al.
4,265,990 A 5/1981 Stolka et al.
4,281,054 A 7/1981 Horgan et al.
4,297,425 A 10/1981 Pai et al.
4,298,697 A 11/1981 Baczek et al.
4,306,008 A * 12/1981 Pai et al. ..... 430/58.8
4,338,390 A 7/1982 Lu
4,560,635 A 12/1985 Hoffend et al.
4,599,286 A 7/1986 Limburg et al.
5,681,679 A 10/1997 Schank et al.
5,702,854 A 12/1997 Schank et al.
5,976,744 A 11/1999 Fuller et al.
6,197,464 B1 3/2001 Dinh et al.
7,622,231 B2 * 11/2009 McGuire et al. ..... 430/58.8
2002/0051918 A1 5/2002 Miyamoto et al.
2004/0067427 A1 4/2004 Tong et al.
2006/0105264 A1 5/2006 Dinh et al.
2007/0072101 A1 3/2007 Dinh et al.

OTHER PUBLICATIONS

U.S. Appl. No. 11/275,546, filed Jan. 13, 2006.
U.S. Appl. No. 11/295,134, filed Nov. 18, 2004.
Canadian Office Action in Canadian Application No. 2,607,417 dated Jul. 22, 2010.

* cited by examiner

*Primary Examiner*—Mark A Chapman
(74) *Attorney, Agent, or Firm*—Oliff & Berridge, PLC

(57) ABSTRACT

A photoreceptor with a substrate, a charge generating layer, a charge transport layer including N,N,N'N'-tetra(4-methylphenyl)-(1,1'-biphenyl)-4,4'-diamine, having a purity of from about 95 percent to about 100 percent, and a protective overcoating layer, optionally including a hole transport material other than N,N,N'N'-tetra(4-methylphenyl)-(1,1'-biphenyl)-4,4'-diamine, that will discharge from about 85% to about 100% of its surface potential in from 0 to about 40 milliseconds upon being subjected to xerographic charging and exposure to radiant energy of from about 1 erg/cm$^2$ to about 5 ergs/cm$^2$.

20 Claims, 2 Drawing Sheets

PHOTORECEPTOR CONTAINING SUBSTITUTED BIPHENYL DIAMINE AND METHOD OF FORMING SAME

CROSS-REFERENCE TO RELATED APPLICATIONS

There is illustrated in copending U.S. patent application Ser. No. 11/756,109, to McGuire, et al., filed concurrently herewith, the entire disclosure of which is totally incorporated herein by reference, a hole transport material comprising a substituted biphenyl diamine wherein, when incorporated into a photoreceptor, the photoreceptor will discharge from about 85% to about 100% of its surface potential in from 0 to about 40 milliseconds upon being subjected to xerographic charging and exposure to radiant energy of from about 1 erg/cm$^2$ to about 5 ergs/cm$^2$.

Copending U.S. patent application Ser. No. 11/275,546 filed Jan. 12, 2006, discloses an electrophotographic imaging member comprising a substrate, a charge generating layer, a charge transport layer, and an overcoating layer, said overcoating layer comprising a cured film formed from a film-forming resin composition comprising at least a melamine compound, a polyol, and a charge transport compound, wherein the charge transport compound is represented by:

$$Q\text{-}[L\text{-}OH]_n$$

wherein Q represents a charge transport component, L represents a divalent linkage group, and n represents a number of repeating segments or groups.

Copending U.S. patent application Ser. No. 11/234,275 filed Sep. 26, 2005, discloses an electrophotographic imaging member comprising a substrate, a charge generating layer, a charge transport layer, and an overcoating layer, said overcoating layer comprising a cured polyester polyol or cured acrylated polyol film-forming resin and a charge transport material.

Copending U.S. patent application Ser. No. 11/295,134 filed Dec. 13, 2005, discloses an electrophotographic imaging member comprising a substrate, a charge generating layer, a charge transport layer, and an overcoating layer, said overcoating layer comprising a terphenyl arylamine dissolved or molecularly dispersed in a polymer binder.

Copending U.S. patent application Ser. No. 10/992,913 filed Nov. 18, 2004, discloses a process for preparing an overcoat for an imaging member, said imaging member comprising a substrate, a charge transport layer, and an overcoat positioned on said charge transport layer, wherein said process comprises: a) adding and reacting a prepolymer comprising a reactive group selected from the group consisting of hydroxyl, carboxylic acid and amide groups, a melamine formaldehyde crosslinking agent, an acid catalyst, and an alcohol-soluble small molecule to form an overcoat solution; and b) subsequently providing said overcoat solution onto said charge transport layer to form an overcoat layer.

The appropriate components and process aspects of the foregoing, such as the imaging member composition, components and methods, may be selected for the present disclosure in embodiments thereof. The entire disclosures of the above-mentioned applications are totally incorporated herein by reference.

TECHNICAL FIELD

This disclosure is generally directed to electrophotographic imaging members and, more specifically, to layered photoreceptor structures with a charge transport layer including N,N,N'N'-tetra(4-methylphenyl)-(1,1'-biphenyl)-4,4'-diamine having a purity of from about 95 percent to about 100 percent; and a protective overcoating layer optionally including a hole transport material other than N,N,N'N'-tetra(4-methylphenyl)-(1,1'-biphenyl)-4,4'-diamine; where the photoreceptor will discharge from about 85% to about 100% of its surface potential in from 0 to about 40 milliseconds upon being subjected to xerographic charging and exposure to radiant energy of from about 1 erg/cm$^2$ to about 5 erg/cm$^2$. This disclosure also relates to processes for making and using the imaging methods.

REFERENCES

U.S. Pat. No. 5,702,854 described an electrophotographic imaging member including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking and crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,681,679 discloses a flexible electrophotographic imaging member including a supporting substrate and a resilient combination of at least one photoconductive layer and an overcoating layer, the at least one photoconductive layer comprising a hole transporting arylamine siloxane polymer and the overcoating comprising a crosslinked polyamide doped with a dihydroxy amine. This imaging member may be utilized in an imaging process including forming an electrostatic latent image on the imaging member, depositing toner particles on the imaging member in conformance with the latent image to form a toner image, and transferring the toner image to a receiving member.

U.S. Pat. No. 5,976,744 discloses an electrophotographic imaging member including a supporting substrate coated with at least one photoconductive layer, and an overcoating layer, the overcoating layer including a hydroxy functionalized aromatic diamine and a hydroxy functionalized triarylamine dissolved or molecularly dispersed in a crosslinked acrylated polyamide matrix, the hydroxy functionalized triarylamine being a compound different from the polyhydroxy functionalized aromatic diamine. The overcoating layer is formed by coating. The electrophotographic imaging member may be imaged in a process.

U.S. Pat. No. 4,297,425 discloses a layered photosensitive member comprising a generator layer and a transport layer containing a combination of diamine and triphenyl methane molecules dispersed in a polymeric binder.

U.S. Pat. No. 4,050,935 discloses a layered photosensitive member comprising a generator layer of trigonal selenium and a transport layer of bis(4-diethylamino-2-methylphenyl) phenylmethane molecularly dispersed in a polymeric binder.

U.S. Pat. No. 4,281,054 discloses an imaging member comprising a substrate, an injecting contact, or hole injecting electrode overlying the substrate, a charge transport layer comprising an electrically inactive resin containing a dispersed electrically active material, a layer of charge generator material and a layer of insulating organic resin overlying the charge generating material. The charge transport layer can contain triphenylmethane.

U.S. Pat. No. 4,599,286 discloses an electrophotographic imaging member comprising a charge generation layer and a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof. An electrophotographic imaging process using this member is also described.

U.S. Pat. No. 4,306,008 discloses imaging or photosensitive members with at least two electrically operative layers of a photoconductive layer and a charge transport containing a polycarbonate resin and from about 25 to about 75 percent by weight of a tetra-alkyl amine, of the formula recited in the abstract and column 6.

The disclosures of each of the foregoing patents are hereby incorporated by reference herein in their entireties. The appropriate components and process aspects of the each of the foregoing patents may also be selected for the present compositions and processes in embodiments thereof.

BACKGROUND

In electrophotography, also known as Xerography, electrophotographic imaging or electrostatographic imaging, the surface of an electrophotographic plate, dram, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For Example, the imaging member may be a homogeneous layer of a single material such as vitreous selenium or it may be a composite layer containing a photoconductor and other materials. In addition, the imaging member may be layered in which each layer making up the member performs a certain function. Current layered organic imaging members generally have at least a substrate layer and two electro active or photo active layers. These active layers generally include (1) a charge generating layer containing a light-absorbing material, and (2) a charge transport layer containing hole transport molecules or materials. These layers can be in a variety of orders to make up a functional device, and sometimes can be combined in a single or mixed layer. The substrate layer may be formed from a conductive material. Alternatively, a conductive layer can be formed on a nonconductive inert substrate by a technique such as but not limited to sputter coating.

The charge generating layer is capable of photogenerating a charge and injecting the photogenerated charge into the charge transport layer or other layer.

In the charge transport layer, the hole transport molecules may be in a polymer binder. In this case, the hole transport molecules provide hole or electron transport properties, while the electrically inactive polymer binder provides mechanical properties. Alternatively, the charge transport layer can be made from a charge transporting polymer such as vinyl polymer, polysilylene or polyether carbonate, wherein the charge transport properties are chemically incorporated into the mechanically robust polymer.

Imaging members may also include a charge blocking layer(s) and/or an adhesive layer(s) between the charge generating layer and the conductive substrate layer. In addition, imaging members may contain protective overcoatings. These protective overcoatings can be either electroactive or inactive, where electroactive overcoatings are generally preferred. Further, imaging members may include layers to provide special functions such as incoherent reflection of laser light, dot patterns and/or pictorial imaging or subbing layers to provide chemical sealing and/or a smooth coating surface.

Imaging members are generally exposed to repetitive electrophotographic cycling, which subjects the exposed charge transport layer or alternative top layer thereof to mechanical abrasion, chemical attack and heat. This repetitive cycling leads to a gradual deterioration in the mechanical and electrical characteristics of the exposed charge transport layer.

Although excellent toner images may be obtained with multilayered belt or drum photoreceptors, it has been found that as more advanced, higher speed electrophotographic copiers, duplicators and printers are developed, there is a greater demand on copy quality. A delicate balance in charging image and bias potentials, and characteristics of the toner and/or developer, must be maintained. This places additional constraints on the quality of photoreceptor manufacturing, and thus, on the manufacturing yield.

Despite the various approaches that have been taken for forming imaging members, there remains a need for improved imaging member design, to provide improved imaging performance, longer lifetime, and the like.

SUMMARY

This disclosure addresses some or all of the above problems, and others, by providing a photoreceptor comprising a substrate a charge generating layer; a charge transport layer comprising N,N,N'N'-tetra(4-methylphenyl)-(1,1'-biphenyl)-4,4'-diamine having a purity of from about 95 percent to about 100 percent; and a protective overcoating layer optionally comprising a hole transport material other than N,N,N'N'-tetra(4-methylphenyl)-(1,1'-biphenyl)-4,4'-diamine; wherein the photoreceptor will discharge from about 85% to about 100% of its surface potential in from 0 to about 40 milliseconds upon being subjected to xerographic charging and exposure to radiant energy of from about 1 erg/cm$^2$ to about 5 ergs/cm$^2$.

In an embodiment, the present disclosure provides a process for forming a photoreceptor comprising providing a photoreceptor substrate; applying a charge generating layer; applying a charge transport layer comprising N,N,N'N'-tetra(4-methylphenyl)-(1,1'-biphenyl)-4,4'-diamine having a purity of from about 95 percent to about 100 percent; and applying a protective overcoating layer over the substrate optionally comprising a hole transport material other than N,N,N'N'-tetra(4-methylphenyl)-(1,1'-biphenyl)-4,4'-diamine; wherein the photoreceptor will discharge from about 85% to about 100% of its surface potential in from 0 to about 40 milliseconds upon being subjected to xerographic charging and exposure to radiant energy of from about 1 erg/cm$^2$ to about 5 ergs/cm$^2$.

In another embodiment, the present disclosure provides a process a method of forming an image, comprising applying a charge to a photoreceptor comprising at least a charge transport layer comprising N,N,N'N'-tetra(4-methylphenyl)-(1,1'-biphenyl)-4,4'-diamine having a purity of from about 95 percent to about 100 percent, and a protective overcoating layer optionally comprising a hole transport material other than N,N,N'N'-tetra(4-methylphenyl)-(1,1'-biphenyl)-4,4'-diamine; exposing the photoreceptor to electromagnetic radiation; developing a latent image formed by exposing the photoreceptor to the electromagnetic radiation to form a visible image; and transferring the visible image to a print substrate; wherein the photoreceptor will discharge from about 85% to about 100% of its surface potential in from 0 to about 40 milliseconds upon being subjected to xerographic charging and exposure to radiant energy of from about 1 erg/cm$^2$ to about 5 ergs/cm$^2$.

Advantages provided by the present disclosure include, in embodiments, photoreceptors having desirable electrical and functional properties. In embodiments, the inclusion of an overcoat layer that excludes N,N,N'N'-tetra(4-methylphenyl)-(1,1'-biphenyl)-4,4'-diamine imparts superior crack resistance, wear resistance and scratch resistance, while inclusion of N,N,N'N'-tetra(4-methylphenyl)-(1,1'-biphenyl)-4,4'-diamine in the charge transport layer imparts negligible changes (i.e. negligible cycling-up) during prolonged electrical cycling (e.g. 10,000 cycles), a significantly low post-expose voltage ($V_{Low}$ of about 25 Volts) and increased resistance to running deletion and improved rate of discharge.

EMBODIMENTS

Figure 1:
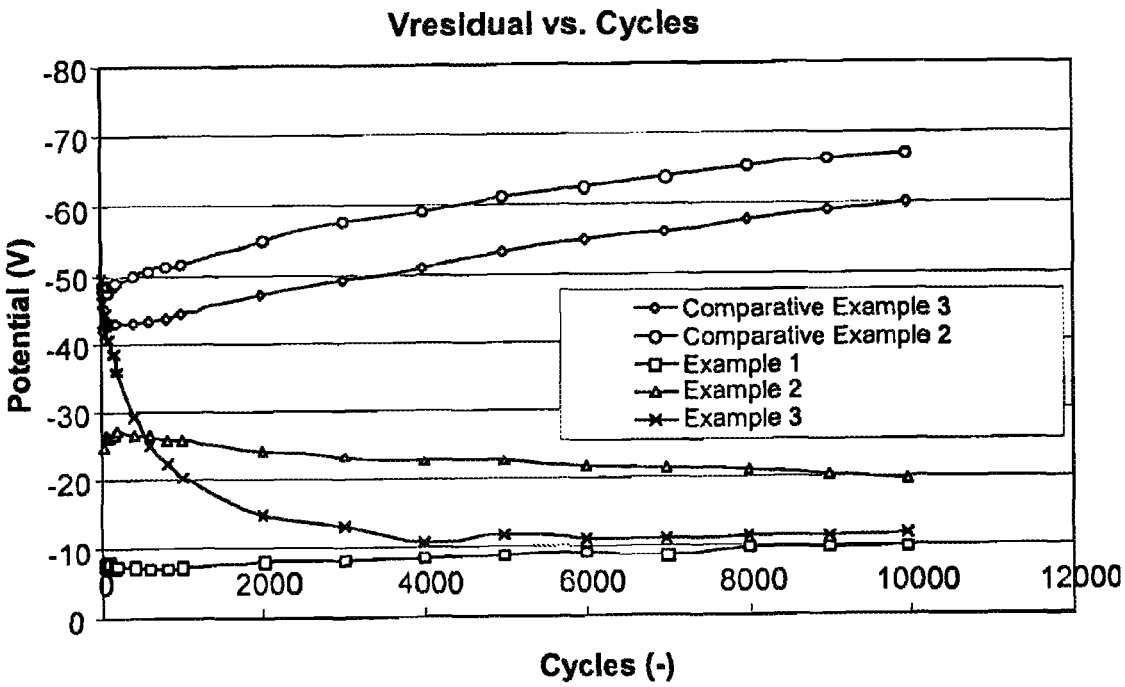
FIG. 1 is a graph showing changes in post-erase potential ($V_{residual}$) for photoreceptors of Examples and Comparative Examples of the disclosure.

Xerographic photoreceptors are known in the art. Xerographic photoreceptors may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a charge transport layer is formed on the charge generation layer, followed by an optional overcoat layer. This structure may have the charge generation layer on top of or below the charge transport layer.

The charge transport layer comprises a hole transporting small molecule dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" as used herein is defined as a hole transporting small molecule dispersed in the polymer, the small molecules being dispersed in the polymer on a molecular scale. Any suitable hole transporting or electrically active small molecule may be employed in the charge transport layer. The expression hole transporting "small molecule" is defined herein as a monomer that allows the free charge photogenerated in the transport layer to be transported across the transport layer. Typical hole transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazine, and oxadiazoles such as 2,5-bis(4-N,N'-diethylaminophenyl)-1,2,4-oxadiazole, stilbenes and the like. As indicated above, suitable electrically active small molecule hole transporting compounds are dissolved or molecularly dispersed in electrically inactive polymeric film forming materials. Small molecule hole transporting compounds that permit injection of holes from the pigment into the charge generating layer with high efficiency and transport them across the charge transport layer with very short transit times are N,N'-diphenyl-N,N'-bis(3-methylphenyl)-(1,1'-biphenyl)-4,4'-diamine, N,N,N',N'-tetra-p-tolylbiphenyl-4,4'-diamine, and N,N'-Bis(3-methylphenyl)-N,N'-bis[4-(1-butyl)phenyl]-[p-terphenyl]-4,4'-diamine. If desired, the hole transport material in the charge transport layer may comprise a polymeric hole transport material or a combination of a small molecule hole transport material and a polymeric hole transport material.

In accordance with embodiments, at least one layer of the xerographic photoreceptor comprises substituted biphenyl diamine, such as N,N,N'N'-tetra(4-methylphenyl)-(1,1'-biphenyl)-4,4'-diamine, to provide improved electrical properties to the photoreceptor. In certain embodiments, the substituted biphenyl diamine is dispersed in at least the charge transport layer.

In embodiments, part or all of the conventional charge transport materials, such as the small molecule hole transporting compounds, are replaced by a specific small molecule hole transporting compound that is a substituted biphenyl diamine of the general structure:

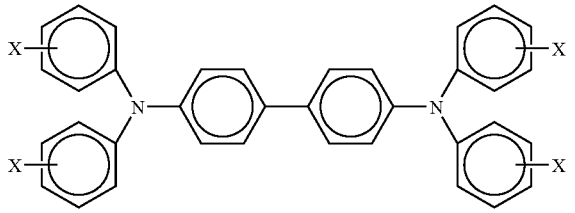

wherein each X is an alkyl group comprising from 1 to about 20 carbon atoms, and wherein each X is the same, such as N,N,N'N'-tetra(4-methylphenyl)-(1,1'-biphenyl)-4,4'-diamine, in order to provide improved electrical and mechanical properties to the photoreceptor. This dispersion of substituted biphenyl diamine leads to significant improvement in photoreceptor performance as demonstrated by negligible changes during prolonged electrical cycling, significantly low post-expose voltage, increased resistance to running deletion, and increased rate of discharge.

In the substituted biphenyl diamine, the substitutions can include any suitable substitutions to provide an acceptable charge transport material. For example, suitable alkyl group substitutions include alkyl groups containing one to about twenty carbon atoms, such as methyl, ethyl, propyl, butyl, pentyl, hexyl, heptyl, octyl, nonyl, and decyl, which can be straight or branched, and can be optionally substituted with other functional groups. In embodiments, each alkyl group substitution is the same, as in for example, N,N,N'N'-tetra(4-methylphenyl)-(1,1'-biphenyl)-4,4'-diamine.

In embodiments, the charge transport layer may comprise a substituted biphenyl diamine of high quality such that, when incorporated into a photoreceptor, the photoreceptor will exhibit an improved rate of discharge of its surface potential. For example, the photoreceptor may discharge from about 85% to about 100% of its surface potential in from about 0 to about 40 milliseconds upon being subjected to xerographic charging and exposure to radiant energy of from about 1 erg/cm$^2$ to about 5 ergs/cm$^2$, such as from about 85% to about 100% of its surface potential in from about 0 to about 40 milliseconds of being subjected to xerographic charging and exposure to radiant energy of about 2 ergs/cm$^2$. In embodiments, a photoreceptor comprising the high quality substituted biphenyl diamine may have a post erase voltage of from about 0 to about 10 volts, from an initial charging voltage of from about 400 to about 1000 volts, when erase energy is about 200 ergs/cm$^2$. The substituted biphenyl diamine may also exhibit stable xerographic cycling over 10,000 cycles.

As used herein, "high quality" referring to the substituted biphenyl diamine thus refers to a substituted biphenyl diamine that, when incorporated into a photoreceptor, the photoreceptor will discharge from about 85% to about 100% of its surface potential in from 0 to about 40 milliseconds upon being subjected to xerographic charging and exposure to radiant energy of about 1 ergs/cm$^2$ to about 5 ergs/cm$^2$.

In embodiments, in addition to a high quality substituted biphenyl diamine, the charge transport layer may comprise a substituted biphenyl diamine of high purity, such as for example, a purity of from about 95 percent to about 100 percent, such as from about 98 percent to about 100 percent, as determined for example, by HPLC, NMR, GC, LC/MS, GC/MS or by melting temperature data, and such that, when incorporated into a photoreceptor; the substituted biphenyl diamine hole transport component is in embodiments present in at least a charge transport layer of a photoreceptor in an amount of from about 30 to about 65 weight percent, (number values throughout are intended to include all numbers there between, thus about 30 to 65 includes at least all number values of 30, 31, 32, 33, 34, 35, 36, 37, 38 up to 65), from about 40 to about 60 weight percent, or from about 45 to about 55 weight percent; an optional adhesive layer, an optional hole blocking or undercoat layer, and an optional overcoating layer.

Although not limited to any specific theory, it is believed that the high quality of the substituted biphenyl diamine, and the properties provided thereby, may not be directly linked to its chemical purity alone, but instead may be linked to the chemical purity, type and amount of residual impurities, and the like.

The charge transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the charge transport layer to the charge generator layers is desirably maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

In certain embodiments this hole transport material is dispersed within a polymer binder such as a polycarbonate like MAKROLON 5705®, a known polycarbonate resin having a molecular weight average of from about 50,000 to about 100,000, commercially available from Farbenfabriken Bayer A. G. However, other types of binders such as, for example, those referenced below, are suitable for use. The thickness of the charge transport layer can vary, and can be, for example, between from 1 to 100 microns thick such as between from about 10 to about 50 microns thick or between from about 25 to about 30 microns thick. The charge transport layer can be composed entirely from tetraalkyl-substituted biphenyl diamine in a polymer binder, or, optionally, it can comprise one or more additional components such as, for example, one or more additional binder(s), one or more additional hole transport material(s), and/or one or more cross-linking agent (s).

Any suitable electrically inactive resin binder insoluble in the alcohol solvent used to apply the overcoat layer may be employed in the charge transport layer. Typical inactive resin binders include polycarbonate resin, polyester, polyarylate, polysulfone, and the like. Molecular weights can vary, for example, from about 20,000 to about 150,000. Exemplary binders include polycarbonates such as poly(4,4'-isopropylidene-diphenylene)carbonate (also referred to as bisphenol-A-polycarbonate, poly(4,4'-cyclohexylidinediphenylene) carbonate (referred to as bisphenol-Z polycarbonate), poly(4,4'-isopropylidene-3,3'-dimethyl-diphenyl)carbonate (also referred to as bisphenol-C-polycarbonate) and the like. Any suitable hole transporting polymer may also be utilized in the charge transporting layer. The hole transporting polymer should be insoluble in any solvent employed to apply the subsequent overcoat layer described below, such as an alcohol solvent. These electrically active hole transporting polymeric materials should be capable of supporting the injection of photogenerated holes from the charge generation material and be incapable of allowing the transport of these holes therethrough.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like.

To improve photoreceptor wear resistance, a protective overcoat layer can be provided over the photogenerating layer (or other underlying layer). Various overcoating layers are known in the art, and can be used as long as the functional properties of the photoreceptor are not adversely affected.

According to embodiments, the protective overcoating layer comprises a hole transport material, which may be dispersed in a polymer binder. The composition of the polymer binder of the protective overcoating layer may be similar or dissimilar to the composition of the polymer binder of the charge transport layer; however, the hole transport material in the overcoating layer can not comprise N,N,N'N'-tetra(4-methylphenyl)-(1,1'-biphenyl)-4,4'-diamine. The thickness of the protective overcoating layer may vary, and can be, for example, between from 1 to 10 microns thick such as between from about 2 to about 5 microns thick. The protective overcoating layer may be composed entirely of the hole transport material and a polymer binder, or, optionally, it can comprise, for example, one or more additional binder(s), one or more additional hole transport material(s), one or more cross-linking agent(s), and/or one or more catalyst(s) as may be needed. Many hole transport materials may be used in the protective overcoating layer, however certain hole transport materials are more suitable in reducing undesirable running deletion behavior of the photoreceptors or the undesirable electrical cycling up of photoreceptors. Specifically, N,N,N'N'-tetra(4-methylphenyl)-(1,1'-biphenyl)-4,4'-diaminecan not be present in the overcoating layer. Suitable hole transport materials for the protective overcoating layer can be, but are not limited to di-hydroxymethyl-triphenyl-amine, N,N'-diphenyl-N,N'-bis(3-hydroxyphenyl)-[1,1'-biphenyl]-4,4'-diamine, and the like, wherein the hole transport materials may alternatively be used in some PASCO overcoating layer formulations comprising a hydroxyl-containing charge transport molecule, a polyol polymer binder, and a melamine-based curing agent, which, upon thermal curing, will form a crosslinked overcoat. A variety of polymers can be used for the protective overcoating layer binder so long as they satisfy the coatability, mechanical robustness and the electrical requirements of a photoreceptor. Suitable polymer binders include, but are not limited to, polyester-polyols (such as, for example, Desmophen 800), polypropylene glycols (such as, for example, PPG 2000), acrylic polyols (such as, for example, B-60 from OPC Polymers, Joncryl 510 or Joncyl 517 from Johnson Polymers) and the like. Suitable cross-linking agents include, but are not limited to, melamine formaldehyde (such as, for example, Cymel 1130 or Cymel 303) and the like.

In forming the layer containing the tetraalkyl-substituted biphenyl diamine, whether it be the charge transport layer or otherwise, the substituted biphenyl diamine can be simply mixed with the other layer components to form a uniform or substantially uniform dispersion, and thereafter applied to form the layer. For example, where the substituted biphenyl diamine is included in a charge transport layer, the substituted biphenyl diamine can be simply mixed with polymer binder material and a suitable solvent, such as $CH_2Cl_2$ to form the charge transport layer.

The substituted biphenyl diamine can be included in the charge transport layer in any desired amount from about 0 percent to about 75% by weight of the charge transport layer, such as between from about 25% to about 50% by weight of the of the charge transport layer. However, much smaller amounts of substituted biphenyl diamine can be used in forming the layers.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be about 20 angstroms to about 750 angstroms, such as about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer known in the ail may be utilized. Typical adhesive layer materials include, for example, polyesters, polyurethanes, and the like. Satisfactory results may be achieved with adhesive layer thickness of about 0.05 micrometer (500 angstroms) to about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infrared radiation drying, air drying and the like.

At least one electrophotographic imaging layer is formed on the adhesive layer, blocking layer or substrate. The electrophotographic imaging layer may be a single layer that performs both charge generating and hole transport functions as is known in the art or it may comprise multiple layers such as a charge generator layer and hole transport layer. Charge generator layers may comprise amorphous films of selenium and alloys of selenium and arsenic, tellurium, germanium, and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, which have a strong influence on photogeneration.

Any suitable polymeric film forming binder material may be employed as the matrix in the charge generating (photogenerating) layer. Typical polymeric film forming materials include those described, for example, in U.S. Pat. No. 3,121,006, the entire disclosure of which is incorporated herein by reference. Thus, typical, organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, such as from about 20 percent by volume to about 30 percent by volume of the photogenerating pigment dispersed in about 70 percent by volume to about 80 percent by volume of the resinous binder composition.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing the solvent of a solvent coated layer may be effected by any suitable conventional technique such as oven drying, infrared radiation drying, air drying and the like.

Advantages provided by the present disclosure include, in embodiments, photoreceptors having desirable electrical and functional properties. For example, photoreceptors in embodiments have one or more of (i) negligible changes (i.e. negligible cycling-up) during prolonged electrical cycling (e.g. 10,000 cycles), (ii) a significantly low post-expose voltage ($V_{Low}$ of about 25 Volts) and (iii) increased resistance to running deletion and improved rate of discharge.

Also, included within the scope of the present disclosure are methods of imaging and printing with the imaging members illustrated herein. These methods generally involve the formation of an electrostatic latent image on the imaging member; followed by developing the image with a toner composition comprised, for example, of thermoplastic resin, colorant, such as pigment, charge additive, and surface additives, reference U.S. Pat. Nos. 4,560,635, 4,298,697 and 4,338,390, the disclosures of which are totally incorporated herein by reference; subsequently transferring the image to a suitable substrate; and permanently affixing the image thereto. In those environments wherein the device is to be used in a printing mode, the imaging method involves the same process with the exception that exposure can be accomplished with a laser device or image bar.

The following Examples are being submitted to illustrate embodiments of the present disclosure. These Examples are intended to be illustrative only, and are not intended to limit the scope of the present disclosure. Also, parts and percentages are by weight unless otherwise indicated. Comparative Examples and data are also provided.

EXAMPLES

Comparative Example 1

Preparation of a Photoreceptor Comprising N,N,N'N'-tetra(4-methylphenyl)-(1,1'-biphenyl)-4,4'-diamine Without a Protective Overcoating Layer An imaging or photoconducting member was prepared in accordance with the following procedure. A metallized mylar substrate was provided and a HOGaPc/poly(bisphenol-Z carbonate) photogenerating layer was machine coated over the substrate. The photogenerating layer was overcoated with a charge transport layer prepared by introducing into an amber glass bottle 50 weight percent of high quality N,N,N'N'-tetra (4-methylphenyl)-(1,1'-biphenyl)-4,4'-diamine (Compound 1), synthesized as discussed above, having a purity of from about 99 to about 100 percent as determined by HPLC and NMR and 50 weight percent of MAKROLON 5705®, a known polycarbonate resin having a molecular weight average of from about 50,000 to about 100,000, commercially available from Farbenfabriken Bayer A. G. The resulting mixture was then dissolved in methylene chloride to form a solution containing 15 percent by weight solids. This solution was applied on the photogenerating layer to form a layer coating that upon drying (120° C. for 1 minute) had a thickness of 30 microns. No protective overcoating layer is applied to the charge transport layer, and thus the device is not according to certain embodiments of the present disclosure.

Comparative Examples 2 and 3

Production-Grade Photoreceptors

For comparison purposes, Commercially available photoreceptors containing N,N'-diphenyl-N,N-bis(3-methylphenyl)-1,1'-biphenyl-4,4'-diamine transport molecule at concentrations of about 43% (comparative example 2) and about 50% (comparative example 3) are used as "benchmark" reference devices.

Examples 1-3

Preparation of a Xerographic Photoreceptor with Substituted Aryl Diamine in the Charge Transport Layer and a Protective Overcoating Layer Three photoreceptor test devices are prepared in the same manner as Comparative Example 1, by creating a charge transport layer with a mixture of N,N,N'N'-tetra(4-methylphenyl)-(1,1'-biphenyl)-4,4'-diamine and MAKROLON 5705® in a 50:50 weight ratio, and applying an approximately 29 micron thick coating of the mixture to the charge generating layer. Additionally, three different protective overcoating layers approximately 2-3 microns thick are applied to the charge transport layers. Overcoating layer formulation A is applied to Example 1 overcoating layer formulation B is applied to Example 2 and overcoating layer formulation C is applied to Example 3. The protective overcoating formulations are shown in TABLE 1 below.

TABLE 1

| | Overcoat A | Overcoat B | Overcoat C |
|---|---|---|---|
| Binder 1 | Polychem 7558-B-60 (60% solids) 1.0 g | Desmophen 800 1.0 g | Polychem 7558-B-60 (60% solids) 1.0 g |
| Binder 2 | PPG 2000 0.4 g | | PPG 2000 0.4 g |
| Hole transport material | HTMA 0.8 g | $TPA(CH_2OH_2)_2$ 0.8 g | $TPA(CH_2OH_2)_2$ 0.8 g |
| Curing agent | Cymel 1130 0.6 g | Cymel 1130 0.6 g | Cymel 1130 0.6 g |
| Catalyst | pTSA (8% solution) 0.2 g | pTSA (8% solution) 0.2 g | pTSA (8% solution) 0.2 g |
| Solvent | Dowanol PM 5 g | Dowanol PM 5 g | Dowanol PM 5 g |

"HTMA" refers to N,N'-diphenyl-N,N'-bis(3-hydroxyphenyl)-[1,1'-biphenyl]-4,4'-diamine,
"TPA" refers to 4,4'-(3,4-dimethylphenylazanediyl)bis(4,1-phenylene)dimethanol,
"Polychem 7558-B-60" refers to an acrylic polyol, and
"PPG 2000" refers to polypropylene glycol with $M_n$ equal to 2000.

Example 4

Electrical Cycling

The long term electrical cycling performance was measured for devices of Examples 1-3 and Comparative Examples 2-3 over 10,000 cycles at ambient conditions.

FIG. 1 shows changes in post-erase potential ($V_{residual}$) for the Examples and Comparative Examples 2 and 3. From FIG. 1, it is seen that the photoreceptors of Examples 1-3 out perform both the Comparative Example devices, as is evident in the significantly lower cycling-up change in $V_{residual}$ behavior for devices in Examples 1-3, which indicates increased cycling stability resulting from the composition of the overcoating layer.

Example 5

Post Cycling Photo-Induced Discharge Curves (PIDCs)

The PIDCs of devices Examples 1-3 as well as reference device Comparative Example 2 were measured after the devices had been cycled for 10,000 cycles.

Figure 2:
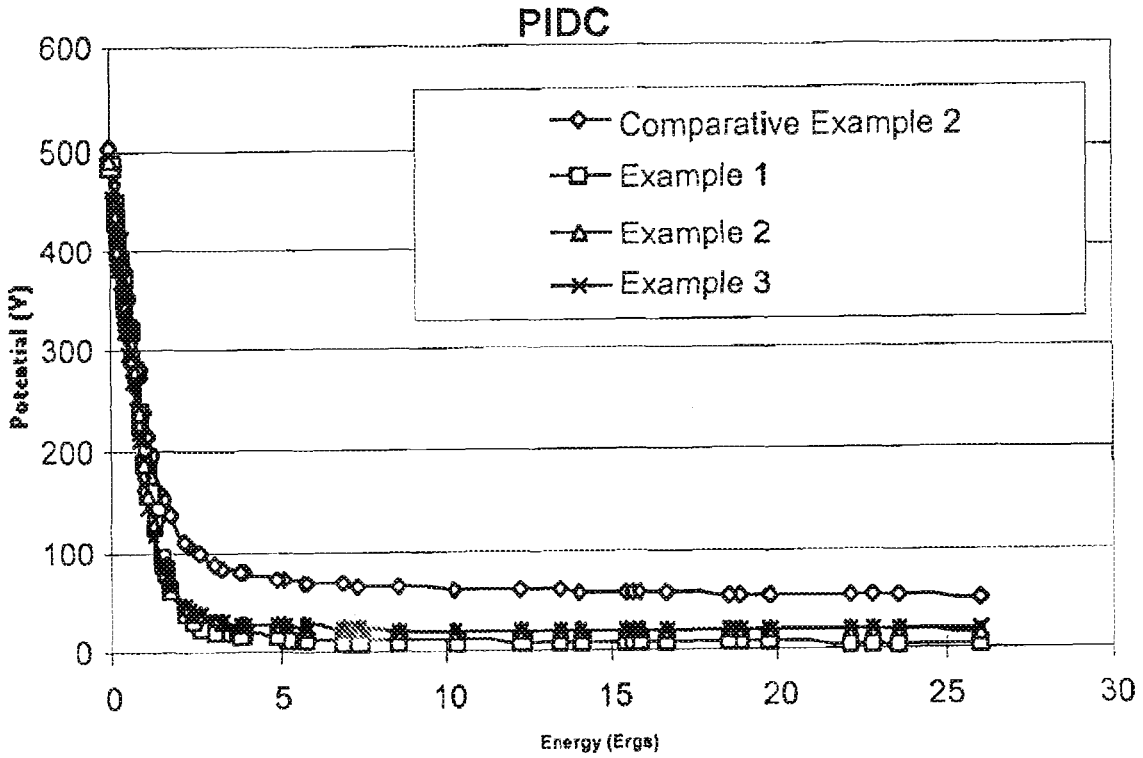
FIG. 2 is a graph of PIDC (Photo-Induced Discharge Curve) curves for photoreceptors of Examples and Comparative Examples of the disclosure.

The results from the measurements are shown below in FIG. 2. As can be seen from FIG. 2, devices Examples 1-3 demonstrate lower post-exposure potential ($V_{Low}$) amounting, for example, to approximately 25 Volts for an exposure light energy of 25 ergs/cm$^2$, versus approximately 50 Volts for an exposure light energy of 25 ergs/cm$^2$ measured in the Comparative Example 2 reference photoreceptor. The lower potential of photoreceptors Examples 1-3 reflects better electrical performance than the commercially available N,N'-diphenyl-N,N-bis(3-methylphenyl)-1,1'-biphenyl-4,4'-diamine based photoreceptor.

Example 6

Running LCM (Lateral Charge Migration) Deletion

Preliminary tests were performed evaluating the running LCM deletion performance on the devices in Examples 1-3 and also on the reference devices in Comparative Examples 1-3. The results demonstrate that while the devices in Example 1-3 show less deletion versus the devices in Comparative Examples 2-3, Comparative Example 1 (a photoreceptor device without a protective overcoating layer) showed much higher deletion, which is less desirable, than the devices in Comparative Examples 2-3. This observation underscores the importance, of including a protective overcoating layer in the photoreceptor when the charge transport layer comprises a substituted aryl diamine.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A photoreceptor comprising
a substrate;
a charge generating layer;
a charge transport layer comprising N,N,N',N'-tetra(4-methylphenyl)-(1,1'-biphenyl)-4,4'-diamine having a purity of from about 95 percent to about 100 percent; and
a protective overcoating layer comprising a hole transport material other than N,N,N',N'-tetra(4-methylphenyl)-(1,1'-biphenyl)-4,4'-diamine;
wherein the photoreceptor will discharge from about 85% to about 100% of its surface potential in from 0 to about 40 milliseconds upon being subjected to xerographic charging and exposure to radiant energy of from about 1 erg/cm$^2$ to about 5 ergs/cm$^2$.

2. The photoreceptor of claim 1, wherein each of the charge transport layer and the protective overcoating layer further comprise a polymer binder.

3. The photoreceptor of claim 1, wherein the charge transport layer is between from 1 to 100 microns thick.

4. The photoreceptor of claim 1, wherein the charge transport layer is between from 10 to 50 microns thick.

5. The photoreceptor of claim 1, wherein the charge transport layer is between from 25 to 30 microns thick.

6. The photoreceptor of claim 1, wherein N,N,N',N'-tetra(4-methylphenyl)-(1,1'-biphenyl)-4,4'-diamine is present in an amount of from about 1% to about 75% by weight of the charge transport layer.

7. The photoreceptor of claim 1, wherein the N,N,N',N'-tetra(4-methylphenyl)-(1,1'-biphenyl)-4,4'-diamine is present in an amount of from about 25% to about 50% by weight of the charge transport layer.

8. The photoreceptor of claim 1, wherein the N,N,N',N'-tetra(4-methylphenyl)-(1,1'-biphenyl)-4,4'-diamine is the only hole transport material present in the charge transport layer.

9. The photoreceptor of claim 1, wherein the charge transport layer further comprises at least one selected from the group consisting of:
one or more binder(s);
one or more additional hole transport material(s); and
one or more cross-linking agent(s).

10. The photoreceptor of claim 1, wherein the protective overcoating layer is between from 1 to 10 microns thick.

11. The photoreceptor of claim 1, wherein the protective overcoating layer is between from 2 to 5 microns thick.

12. The photoreceptor of claim 1, wherein the protective overcoating layer is entirely composed of a hole transport material dispersed in a polymer binder.

13. The photoreceptor of claim 1, wherein the protective overcoating layer further comprises at least one selected from the group consisting of:

one or more binder(s);

one or more additional hole transport material(s);

one or more cross-linking agent(s); and/or one or more catalyst(s).

14. The protective overcoating layer of claim 13, wherein the additional hole transport material is selected from the group consisting of di-hydroxymethyl-triphenyl-amine and N,N'-diphenyl-N,N'-bis(3-hydroxyphenyl)-[1,1'-biphenyl]-4,4'-diamine.

15. The protective overcoating layer of claim 13, wherein the polymer binder is selected from the group consisting of polyester polyols, polypropylene glycols, acrylic polyols and polycarbonate.

16. The protective overcoating layer of claim 13, wherein the cross-linking agent is present and comprises melamine formaldehyde.

17. A process for forming a photoreceptor comprising:

providing a photoreceptor substrate;

applying a charge generating layer;

applying a charge transport layer comprising N,N,N',N'-tetra(4-methylphenyl)-(1,1'-biphenyl)-4,4'-diamine having a purity of from about 95 percent to about 100 percent; and applying a protective overcoating layer over the substrate comprising a hole transport material other than N,N,N',N'-tetra(4-methylphenyl)-(1,1'-biphenyl)-4,4'-diamine; wherein the photoreceptor will discharge from about 85% to about 100% of its surface potential in from 0 to about 40 milliseconds upon being subjected to xerographic charging and exposure to radiant energy of from about 1 erg/cm$^2$ to about 5 ergs/cm$^2$.

18. The process of claim 17, wherein the applying comprises:

applying a charge generating layer to said substrate;

applying a charge transport layer solution comprising at least N,N,N',N'-tetra(4-methylphenyl)-(1,1'-biphenyl)-4,4'-diamine and a film-forming polymer to said charge generating layer; and curing said charge transport layer solution to form said charge transport layer.

19. The process of claim 18, wherein the charge transport layer solution is formed by preparing a solution of N,N,N',N'-tetra(4-methylphenyl)-(1,1'-biphenyl)-4,4'-diamine, alone or in combination with, said film-forming polymer in a solvent; and optionally further adding solvent or said film-forming polymer.

20. A method of forming an image, comprising:

applying a charge to a photoreceptor comprising at least a charge transport layer comprising N,N,N',N'-tetra(4-methylphenyl)-(1,1'-biphenyl)-4,4'-diamine having a purity of from about 95 percent to about 100 percent, and a protective overcoating layer comprising a hole transport material other than N,N,N',N'-tetra(4-methylphenyl)-(1,1'-biphenyl)-4,4'-diamine;

exposing the photoreceptor to electromagnetic radiation;

developing a latent image formed by exposing the photoreceptor to the electromagnetic radiation to form a visible image; and transferring the visible image to a print substrate;

wherein the photoreceptor will discharge from about 85% to about 100% of its surface potential in from 0 to about 40 milliseconds upon being subjected to xerographic charging and exposure to radiant energy of from about 1 erg/cm$^2$ to about 5 ergs/cm$^2$.

* * * * *